US010713876B2

(12) United States Patent
Stapfer

(10) Patent No.: US 10,713,876 B2
(45) Date of Patent: Jul. 14, 2020

(54) SYSTEM AND METHOD FOR PROCESSING VALUE DOCUMENTS

(71) Applicant: GIESECKE & DEVRIENT GMBH, München (DE)

(72) Inventor: Michael Stapfer, Neubiberg (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 120 days.

(21) Appl. No.: 15/028,467

(22) PCT Filed: Oct. 8, 2014

(86) PCT No.: PCT/EP2014/002725

§ 371 (c)(1),
(2) Date: Apr. 11, 2016

(87) PCT Pub. No.: WO2015/051910

PCT Pub. Date: Apr. 16, 2015

(65) Prior Publication Data

US 2016/0253859 A1 Sep. 1, 2016

(30) Foreign Application Priority Data

Oct. 10, 2013 (DE) ..... 10 2013 016 848

(51) Int. Cl.
*G07D 11/32* (2019.01)
*G07D 11/24* (2019.01)
(Continued)

(52) U.S. Cl.
CPC ..... *G07D 11/32* (2019.01); *G07D 11/225* (2019.01); *G07D 11/24* (2019.01); *G07D 11/30* (2019.01);
(Continued)

(58) Field of Classification Search
CPC . G07F 19/207; G07F 19/209; G07D 11/0066; G07D 11/0042; G07D 11/0054; G07D 11/0069
See application file for complete search history.

(56) References Cited

U.S. PATENT DOCUMENTS 6,328,208 B1 * 12/2001 Artino ..... G07D 11/009 235/379
6,694,058 B1 * 2/2004 Burchart ..... G06F 3/017 382/115
(Continued)

FOREIGN PATENT DOCUMENTS

CH 617490 A5 5/1980
DE 19806024 A1 8/1999
(Continued)

OTHER PUBLICATIONS

German Examination Report from corresponding German Application No. 102013016848.1, dated May 5, 2014.
(Continued)

*Primary Examiner* — Neil R Mikeska
(74) *Attorney, Agent, or Firm* — Workman Nydegger

(57) ABSTRACT

A system for processing value documents and a corresponding method, include an apparatus for processing value documents, a housing in which the apparatus is integrated and/or a support on which the apparatus is arranged, and a recording device provided in or on the housing and/or on the support for recording actions carried out by an operating person while operating the apparatus. The system and method provide a more reliable recording of the actions performed by the operating person and enables a more reliable later check of the operating process.

19 Claims, 4 Drawing Sheets

(51) Int. Cl.
*G07D 11/225* (2019.01)
*G07F 19/00* (2006.01)
*G07D 11/30* (2019.01)

(52) U.S. Cl.
CPC ..... *G07F 19/207* (2013.01); *G07F 19/209* (2013.01)

(56) References Cited

U.S. PATENT DOCUMENTS 6,731,778 B1 * 5/2004 Oda ..... G06Q 20/1085 348/156
7,641,105 B2 * 1/2010 Scanlon ..... G07F 19/20 235/379
2002/0085745 A1 * 7/2002 Jones ..... G06K 9/033 382/135
2004/0016796 A1 * 1/2004 Hanna ..... G06Q 20/105 235/375
2005/0207634 A1 * 9/2005 Jones ..... G06Q 20/18 382/135
2005/0216888 A1 * 9/2005 Drummond ..... G06F 8/34 717/113
2006/0157918 A1 * 7/2006 Gaber ..... B65H 29/46 271/180
2007/0172106 A1 * 7/2007 Paraskevakos ..... G06K 9/38 382/135
2008/0023539 A1 * 1/2008 Rao ..... G07F 19/20 235/379
2008/0037856 A1 * 2/2008 Paraskevakos ..... G06Q 10/00 382/140
2008/0265019 A1 * 10/2008 Artino ..... G06Q 20/1085 235/379
2010/0157100 A1 * 6/2010 Roquemore, III ... H04N 5/2256 348/234
2012/0038772 A1 * 2/2012 Priesterjahn ..... G07F 19/207 348/150
2012/0038774 A1 * 2/2012 Reimann ..... G07F 19/20 348/150
2012/0077476 A1 * 3/2012 Paraskevakos .... G07D 11/0066 455/414.2
2012/0145782 A1 * 6/2012 Ma ..... G07F 19/207 235/379
2012/0179609 A1 * 7/2012 Agarwal ..... G06Q 20/042 705/44
2012/0200535 A1 * 8/2012 Stienstra ..... G06F 3/0421 345/175
2012/0259778 A1 * 10/2012 Banerjee ..... G06Q 20/10 705/43
2012/0306331 A1 * 12/2012 Bradley ..... G07F 19/205 312/211
2012/0320257 A1 * 12/2012 Shabtay ..... G02B 7/102 348/349
2013/0126739 A1 * 5/2013 Oi ..... G01J 1/0266 250/353
2013/0146657 A1 * 6/2013 Graef ..... G07F 19/203 235/379
2013/0155234 A1 * 6/2013 Iho ..... H04N 7/18 348/143
2014/0201844 A1 * 7/2014 Buck ..... G06F 21/50 726/26
2014/0314336 A1 * 10/2014 Yagi ..... G06T 3/0062 382/282

FOREIGN PATENT DOCUMENTS

DE 20318489 U1 2/2004
EP 1031949 A1 8/2000
EP 1422674 A1 5/2004
GB 2369914 A 6/2002
WO 2009083158 A1 7/2009

OTHER PUBLICATIONS

International Search Report from corresponding PCT Application No. PCT/EP2014/002725, dated Dec. 19, 2014.
International Preliminary Report on Patentability from corresponding PCT Application No. PCT/EP2014/002725, dated Apr. 12, 2016.

* cited by examiner

SYSTEM AND METHOD FOR PROCESSING VALUE DOCUMENTS

BACKGROUND

This invention concerns a system and a method for processing value documents, in particular bank notes, according to the independent claims.

In bank-note processing systems, bank notes are checked with regard to various properties, such as printed image, denomination, authenticity and state, and treated differently depending on the result of the check. Thus, bank notes classified as authentic upon the check are returned to circulation provided they simultaneously meet certain fitness criteria. In contrast, bank notes classified as false or suspect are taken out of circulation, and soiled, worn or defective bank notes are fed to a shredder for destruction. Further, the respectively inputted bank notes can be counted and/or their total value established in bank-note processing systems.

In a frequently occurring application of bank-note processing systems, certain quantities of bank notes are left with a bank or fed to a cash center in the form of deposits by depositors with certain information being stated, in particular the total value of the deposit, in order to be brought to account there using a bank-note processing system, so that the total value can be credited to an account of the depositor. Between the total value established upon the automatic processing of the bank notes and the total value stated by the depositor there might occasionally be deviations which can be due, inter alia, to the operating person carrying out the automatic processing having worked erroneously or in a fraudulent manner.

From WO 2009/083158 A1 it is known to monitor an operating person while operating a machine for processing means of payment by means of a camera and to store the thereby generated image data, in order to be able to later check on the basis of the stored image data, in the case of deviations between the stated value of an effected deposit and the value brought to account, whether said deviation is due to misconduct of the operating person. However, a reliable check of the operating process cannot be guaranteed here in all cases of application.

SUMMARY

It is the object of the present invention to state a system and a method for processing value documents by which as reliable a check of the operating process as possible is attained.

The system for processing value documents, in particular bank notes, according to the invention has: an apparatus for processing value documents, in particular for checking, counting, sorting and/or destroying value documents; a housing in which the apparatus is integrated and/or a support on which the apparatus is arranged; and a recording device provided in or on the housing and/or a recording device provided on the support for recording actions carried out by an operating person while operating the apparatus.

In the corresponding method for processing value documents, in particular bank notes, according to the invention, actions carried out by an operating person while operating an apparatus for processing value documents are recorded by a recording device, wherein the recording device is provided in or on a housing in which the apparatus is integrated and/or on a support on which the apparatus is arranged.

The invention is based on the approach of providing in or on the value-document processing apparatus itself and/or on a support, such as on a table, on which the apparatus is located when in operation, a recording device, such as a photo camera or video camera, with which the actions of an operating person performed before or on the apparatus, in particular in a pre-specified operating region or in the region of the support, while operating the apparatus, such as when supplying and inputting bank notes or removing bank notes from the apparatus, can be recorded. This arrangement of the recording device guarantees that the operating person's hand movements that are especially important for the monitoring of the operating person, such as when he manually opens and empties a deposit, can be recorded reliably and with high sharpness, resolution and brightness, without requiring—as with surveillance cameras arranged above the operating person for example—expensive HD cameras with high focusing depth and high-speed objectives as well as strong ambient illumination. In particular, through the recording device being arranged according to the invention relative to the operating person's position, the operating person's hands and hand movements when supplying or removing bank notes cannot be hidden by the operating person's head or upper part of the body, so that the working region can always be safely captured by the recording device.

Altogether there is thus attained a more reliable recording of the actions performed by the operating person and therefore a more reliable later check of the operating process.

Preferably, the actions carried out by the operating person while operating the apparatus involve supplying value documents intended for processing in the apparatus and/or removing value documents from the apparatus after their processing. Said supplying preferably comprises the time period from placing a container with the bank notes to be processed on the support, through opening and emptying the container and manually or automatically aligning the bank notes, to inserting the aligned bank notes into an input pocket of the apparatus. The recording of the actions upon removal preferably begins at the latest after the last bank note belonging to a bank-note stack to be processed is output onto a stack into an output pocket of the apparatus. This guarantees that all the operating person's actions required for a later check are reliably recorded.

It is further particularly preferred that the recording device is configured for recording still and/or moving images, in particular a video sequence, of the actions carried out by the operating person while operating the apparatus. The corresponding image or video data are stored in a memory. By recording moving images, in particular video sequences, the obtained recordings of the operating person's actions are especially informative and simple to analyze, while the recording of still images has the advantage of requiring relatively little memory.

In a further preferred embodiment, the system has a reading device provided in or on the housing and/or on the support, for capturing at least one information item for identifying the value documents provided for processing. The information item for identifying the value documents intended for processing may be for example a so-called deposit ID, i.e. an information item for uniquely identifying a deposit. Alternatively or additionally, however, the reading device can also capture any other kind of additional information items concerning the value documents to be processed, such as a total value stated by the depositor of a deposit for the bank notes contained in the deposit. In particular, the reading device is configured for capturing an information item, located on a band or a container, for identifying value documents located in the band or in the container and intended for processing, and/or other additional information items concerning the value documents to be processed. The container is preferably a security envelope, such as a so-called safe bag. Further, it is preferred that the information item for identifying the value documents intended for processing is given in the form of a bar code. Alternatively or additionally, however, the additional information item can also be given in plaintext. One or more of the hereinabove described embodiments enable additional information items, in particular information items for identification, for the value documents to be processed to be captured in a reliable manner and associated with the image or video data obtained upon the recording of the operating person's actions. This further improves the later check of the operating process.

In a further advantageous embodiment, the recording device and the reading device are given in the form of a camera device. The functionalities of the recording device and reading device are performed here by the camera device, i.e. the camera device is configured both for recording the actions performed by the operating person and for reading the additional information items, located e.g. on a container, for the value documents to be processed. Preferably, the camera device has besides a receiving element, for example in the form of a CCD or CMOS chip, an objective in the form of an optically imaging element. A later check of the operating process can thereby be realized in an especially simple manner.

In a further preferred embodiment, it may be provided that the camera device is integrated in the housing and there is provided on the housing at least one transparent housing region through which the camera device can record the actions carried out by the operating person and/or capture the additional information items, in particular information items for identification, for the value documents intended for processing. In particular, a first housing region can be so arranged and/or configured here that the actions carried out by the operating person can be captured by the camera device therethrough. Alternatively or additionally, a second housing region can be so arranged and/or configured that additional information items, in particular the information items for identifying the value documents intended for processing, can be captured by the camera device therethrough. Preferably, the first and/or second housing region has a lens element, in particular a Fresnel lens, for imaging the actions carried out by the operating person or the information item for identifying the value documents onto the camera device. These embodiments also contribute—individually or in combination—to reliably monitoring the operating process and thereby further improving the reliability of the later check of the process. The first and/or second housing region can also be formed by an indicator or a display which is transparent to the camera device.

Preferably, there is provided a control device by means of which the captured additional information item, in particular the captured information item for identifying the value documents intended for processing, and the image or video data that are obtained upon the recording of the actions carried out by the operating person while operating the apparatus in connection with the processing of said value documents are mutually associated or mutually linked. An association or linkage can be effected for example by the obtained image or video data being stored in a file which additionally contains the captured additional information item or a pointer to the memory location of the captured additional information item. However, it is also possible to file the respective memory location of the stored image or video data together with the appurtenant deposit ID in a register. Thus, the operating person's actions recorded upon the processing of a certain deposit can, in case of need, be subsequently retrieved in a simple manner on the basis of the corresponding deposit ID and subjected to analysis.

Alternatively or additionally, the control device can be so configured that the control device mutually associates processing data that are generated during the processing of value documents in the apparatus and image or video data that are obtained upon the recording of the actions carried out by the operating person while operating the apparatus in connection with the processing of said value documents. With regard to association or linkage of processing data and video or image data, the above expositions apply accordingly. The processing data may be for example the date and/or time of the processing of the value documents, the identity of the operating person, information items on the processing apparatus or certain properties of the processed value documents, such as serial number and/or denomination. On the basis of the additionally stored processing data the image or video data of the operating person's recorded actions can be subsequently subjected to a plausibility check, which further improves the reliability of the later check of the operating process.

In a further embodiment, there may be provided at least one further recording device for recording actions carried out by an operating person while operating the apparatus. Preferably, the at least one further recording device is arranged above the workplace given by the housing and/or the support. This enables—alternatively or additionally to the recording device provided in or on the housing or on the support—the operating person's actions to also be recorded from other perspectives, such as from an overhead perspective, which further increases the reliability upon the check of the operating process.

It is further preferred that the support has at least one transparent placement area through which the actions carried out by the operating person can be recorded by means of the recording device and/or an additional information item, in particular the information item for identifying the value documents located on the placement area, can be captured by means of the reading device. This also attains a reliable recording of the operating process or capture of additional information items and thus increases the reliability upon the check of the operating process.

BRIEF DESCRIPTION OF THE DRAWINGS

Further advantages, features and application possibilities of the present invention will result from the subsequent description in connection with the figures. There are shown.

DETAILED DESCRIPTION OF VARIOUS EMBODIMENTS

Figure 1:
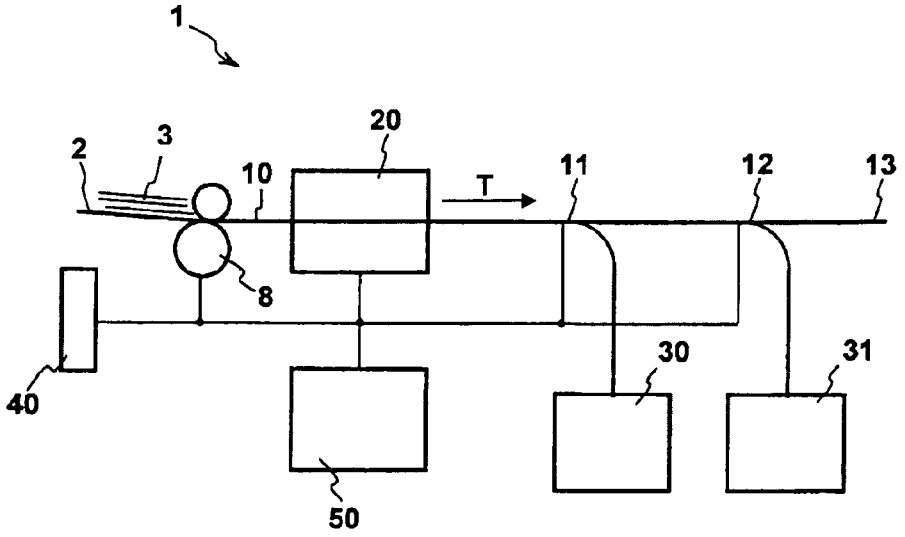
FIG. 1 an example of a schematic construction of a value-document processing system.

FIG. 1 shows an example of a schematic construction of a value-document processing system 1 having an input pocket 2 in which a stack of value documents, in particular bank notes 3, to be processed is supplied, and a singler 8 by which the respective lowermost bank note of the inputted stack is grasped and delivered to a transport device 10—rendered only schematically in the chosen representation—which conveys the bank note in the transport direction T to a sensor device 20.

The sensor device 20 serves to capture physical properties of the bank notes, from which properties of the bank notes, such as printed image, denomination, authenticity and state, can then be derived. Depending on the bank-note properties to be established, the sensor device 20 contains different sensors, such as UV/VIS/IR optical remission and/or transmission sensors, luminescence sensors, ultrasonic sensors, conductivity sensors or magnetic sensors.

The sensor signals generated by the sensor device 20 are relayed for evaluation to a control device 50 in which statements can be derived from the respective sensor signals about different properties of the respective bank note, such as denomination, authenticity, degree of soiling, wear, defects and the presence of foreign objects, such as adhesive tape. Depending on the established properties of the respective bank note, the transport device 10 as well as the gates 11 and 12 along the transport line are controlled by the control device 50 such that the bank note is fed to one of a plurality of output pockets 30 and 31 and placed therein. For example, bank notes that were recognized as authentic are placed in a first output pocket 30, while bank notes classified as false or suspect are placed in a second output pocket 31. The reference number 13 at the end of the represented transport line is intended to indicate that there can be provided further output pockets and/or other devices, for example for storing or destroying bank notes. If the check of a bank note yields for example that it does not meet certain fitness criteria with regard to soiling, wear, defects or the presence of foreign objects, it can be fed directly to a shredder for destruction.

The value-document processing system 1 further has a user interface 40 by which data and/or information items on the bank-note processing and/or instructions to an operating person can be displayed, on the one hand, and data and/or control commands for controlling the bank-note processing can be inputted by an operating person, on the other hand.

In special cases of application, such as upon the processing of deposits in banks, in security transport companies or in so-called cash centers, however, the value-document processing system 1 can preferably also be conceived so as to only check the bank notes of a bank-note stack inputted to the input pocket 2 for authenticity, establish their denomination and compute therefrom a total value of the inputted stack.

Figure 2:
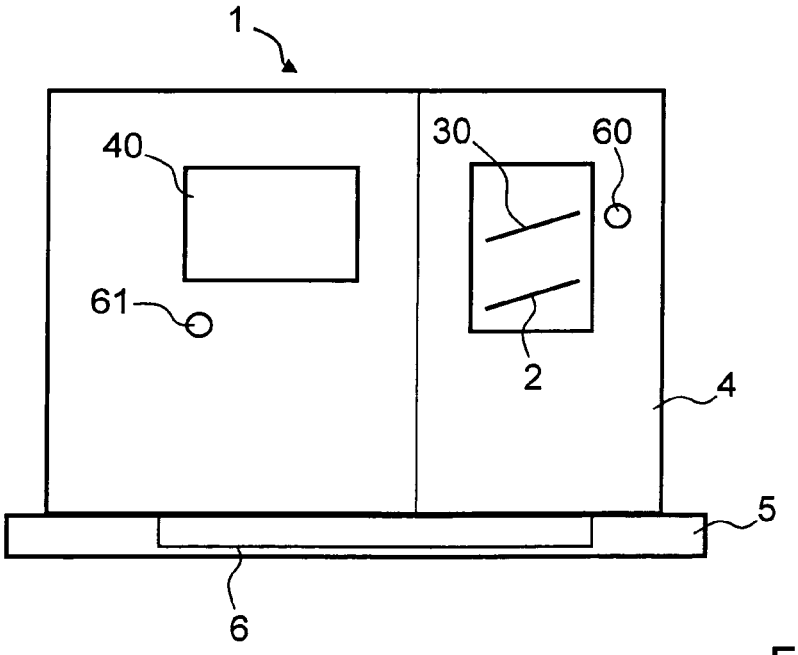
FIG. 2 a first example of a value-document processing system in a front view.

A value-document processing system 1 especially suitable specifically for fast processing of deposits is represented by way of example in FIG. 2 in a front view. The components of the system that are explained in connection with FIG. 1 are accommodated in a housing 4, with the input pocket 2 and the output pocket 30 being so arranged in the front region of the housing 4 that they are readily accessible to an operating person for inputting bank notes, in particular in the form of stacks, to the input pocket 2 or removing them from the output pocket 30. The housing 4 can be arranged on a support 5, for example on a table surface, which is preferably mounted on vertically adjustable legs (not represented).

On the housing 4 there is provided a recording device 60 by means of which an operating person's actions that are performed in the region before the housing 4 can be captured and corresponding image data thereby generated. The recording device 60 is preferably a camera for recording preferably moving images, in particular video sequences, of the respectively performed actions. Alternatively or additionally, however, it may also be advantageous in certain cases of application to record mainly or solely still images with the recording device 60. The image data respectively generated upon the capture of the operating person's actions are stored in a memory which can be provided for example in the control device 50 (see FIG. 1).

The recording device 60 can be mounted for example in a depression provided on the housing 4 or else be attached directly to the outer wall of the housing 4. Alternatively, however, it is also possible to arrange the recording device 60 in the interior of the housing of the system 1 and connect it to the exterior of the housing 4 via an optic, for example one or more lenses and/or a light guide.

Preferably, there is further provided on the housing 4 a reading device 61 which can capture additional information items, in particular on the identity of a bank-note stack intended for processing. These may preferably be information items that are encoded in the form of a bar code and/or stored in an electronic memory in the form of an RFID tag. The bar code or RFID tag is preferably located on a container in which the bank notes intended for processing are located.

Such a container may be for example a so-called tamper-evident envelope or a safe bag. A tamper-evident envelope is a security envelope that guarantees besides protection from external influences in particular also protection from unauthorized access to the bank notes located in the envelope and makes tampering or attempted tampering recognizable. A safe bag differs from a tamper-evident envelope in particular in that a safe bag is reusable, while a tamper-evident envelope becomes useless upon opening and can hence only be employed once.

Alternatively or additionally, however, it is also possible to provide the bar code or the RF-ID tag on a band surrounding the bank notes to be processed, or on a document supplied along with the bank notes, for example in the form of a card.

With regard to the attachment of the reading device 61 on or in the housing 4 the above expositions in connection with the recording device 60 apply accordingly.

In the support 5 there can preferably be provided a placement area 6, for example in the form of a depression, into which the operating person is to place the bank notes to be processed when supplying them, or in whose region an operating person is to handle the bank notes to be processed or that are already processed.

Figure 3:
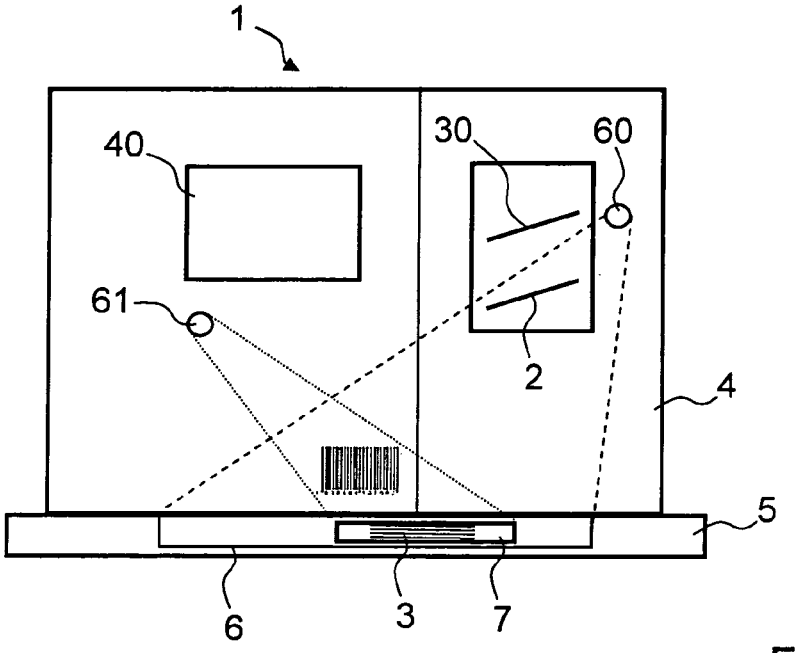
FIG. 3 the first example of a value-document processing system shown in FIG. 2, in a first operation phase.

FIG. 3 shows the example of the value-document processing system 1 shown in FIG. 2, in a first operation phase in which a container 7, in particular a safe bag, with bank notes 3 located therein has been placed by an operating person in the placement area 6 provided therefor, whereupon a bar code located on the container 7 is captured by means of the reading device 61 and the information items contained in the bar code for identifying the container 7 and/or the bank notes 3 located therein are stored in a memory. The field of view of the reading device 61 is indicated by dotted lines in the figure.

As soon as the bar code located on the container 7 has been captured, the recording device 60 begins recording the actions performed by the operating person, in particular in the region of the placement area 6, which is illustrated by a field of view, indicated by dashed lines, of the recording device 60.

The arrangement of the recording device 60 somewhat above the input pocket 2, which is shown in the represented example and particularly preferred, guarantees that both the region of the placement area 6 and the input pocket 2 lie in the field of view of the recording device 60 and thus all the operating person's relevant actions, from supplying the container 7 to placing the bank-note stack 3 in the input pocket 2, are reliably recorded, which will be explained more closely hereinafter.

Figure 4:
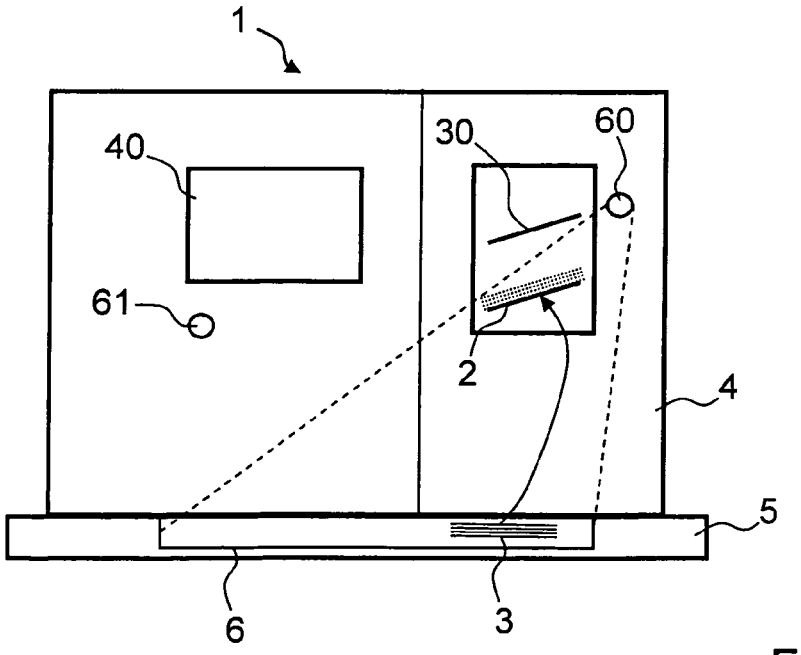
FIG. 4 the first example of a value-document processing system shown in FIG. 2, in a second operation phase.

After insertion of the container 7 into the placement area 6, the operating person is to manually open the container 7 and empty its content, i.e. the bank notes 3 to be processed, on the placement area 6. This processing phase is represented in FIG. 4. In this phase, any coins or foreign bodies that are present can be manually sorted out by the operating person. Further, it is possible to configure the placement area 6 such that it is somewhat inclined relative to the horizontal and/or can perform jerking motions, so that the bank notes 3 located thereon are aligned parallel to one of their edges, in particular to a longitudinal edge. Depending on the arrangement, steepness and shaking direction of the placement area 6, the bank notes 3 can thereby be aligned flush left or flush right. During shaking, the operating person can if necessary perform other manual activities, such as emptying the output pocket 30 or banding the removed bank notes.

The, preferably aligned, bank notes 3 are removed from the placement area 6 by the operating person and inserted into the input pocket 2, which is indicated by the arrow indicated in FIG. 4. This process is also recorded by the recording device 60. Preferably, the recording of the operating person's actions is ended as soon as the singler 8 (see FIG. 1) begins grasping individual bank notes from the bank-note stack 3 inputted in the input pocket 2 and feeding them to further processing in the system 1.

Preferably, the image or video data generated by means of the recording device 60 upon the monitoring of the supplying of the bank-note stack 3 by the operating person, on the one hand, and the bar-code information items read by means of the reading device 61 for identifying the container 7 or the bank-note stack 3 located therein are mutually associated or mutually linked and stored in a memory through the control device 50 (see FIG. 1). If there is a need to reconstruct at a later time which actions the corresponding operating person has performed in connection with the processing of a bank-note stack 3 having a certain deposit ID, the corresponding image or video data can then be retrieved in a simple manner on the basis of the deposit ID associated therewith, and be analyzed.

Alternatively or additionally to the hereinabove described association of the identity information item of a deposit with the image data obtained upon the operating of the system upon the processing of the deposit, the control device 50 of the system 1 can further be so configured that processing data that are generated during the processing of the inputted bank-note stack 3 by the system 1 are associated with the image or video data generated by means of the recording device 60 and/or with the identification information items obtained by means of the reading device 61. The processing data obtained during the processing of the bank-note stack 3 may be for example the date and/or time of the processing of the bank notes 3, the identity of the respective operating person, information items for identifying the processing system 1 and, not least, information items on certain properties of the respectively checked bank notes 3, such as serial number, denomination, printed image, authenticity or state. Due to the linkage of the processing data obtained upon processing with the image data or the identity information item of the deposit, a later plausibility check in particular of the working steps performed by the operating person can be carried out in case the value of the effected deposit deviates from the established value of the deposit.

Figure 5:
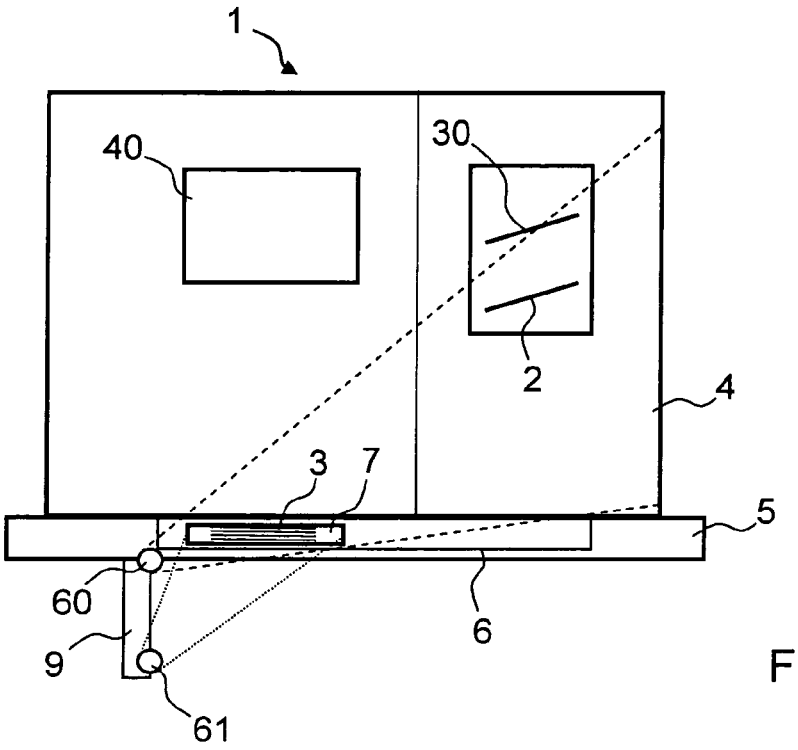
FIG. 5 a second example of a value-document processing system in a front view.

FIG. 5 shows a second example of a value-document processing system 1 in a front view. In this example the recording device 60 is so arranged in the region of the support 5, in particular of a table, that it can record the actions performed by the operating person while handling the inserted container 7 or the bank notes 3 located therein.

Preferably, the recording device 60 is located in the edge region of the placement area 6, the latter being configured to be transparent, for example in the form of a glass shelf, so that the recording device 60 can record the operating person's actions through the transparent placement area 6. As indicated by the indicated dashed lines, the recording device 60 and/or the placement area 6 is so arranged or configured that the operating person's actions performed in the region of the placement area 6 as well as of the input pocket 2 and/or output pocket 30 lie in the field of view of the recording device 60.

Alternatively or additionally, it is also possible to arrange the reading device 61 on the support 5 and/or in the region of the support 5 such that it can read information items, in particular bar codes, located on the inputted container 7 and/or the bank-note stack 3. As with the recording of image or video data by the recording device 60, the reading of the information items, in particular in the form of bar codes, located on the container 7 is effected through the transparent placement area 6 here, too. In the shown example, the reading device 61 is integrated in a support element 9 provided on the support 5, which element can be provided specifically for fastening the reading device 61 or else can be given in the form of a foot on which the support 5 is mounted. Otherwise, the expositions in connection with the examples shown in FIGS. 2 to 4 apply accordingly.

Figure 6:
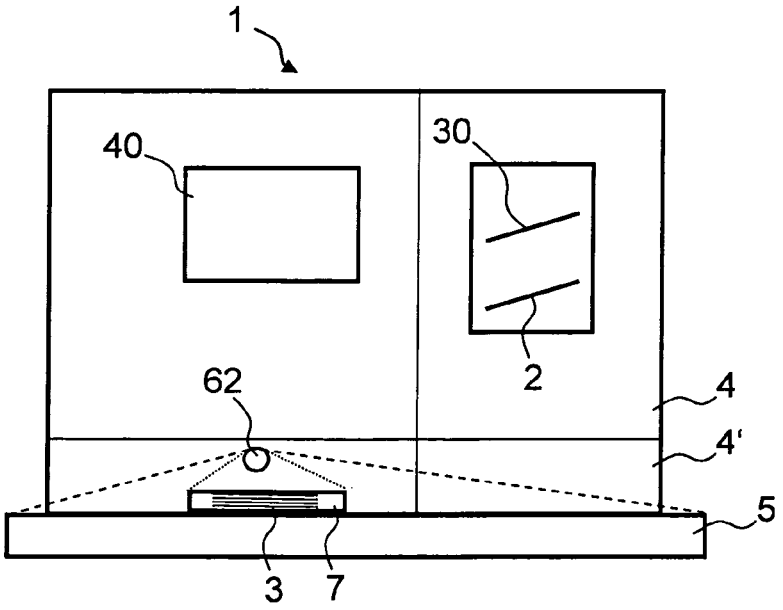
FIG. 6 a third example of a value-document processing system in a front view.

FIG. 6 shows a third example of a value-document processing system 1 in a front view. In the represented example, the functionalities of the recording device 60 and reading device 61 (see FIGS. 2 to 5) are combined in a camera device 62. The camera device 62 therefore constitutes a common device by means of which both the actions carried out by an operating person while operating the system 1 can be recorded and additional information items, in particular in the form of a bar code, located on the container 7 and/or on the bank-note stack 3 can be read. A suitable camera device 62 is for example a camera with as wide-angled a field of view as possible, in particular with a camera optic of small focal length, for example a fish-eye objective. This wide-angle objective captures the near range for bar-code reading and the far range for recording the operating person's actions at the same depth of field (e.g. near point 60 mm, far point infinity). Further, the camera can have a CCD matrix and/or CMOS matrix which is particularly suited for reading bar codes located on the container 7. Preferably, not the whole image region, which might be distorted at the edge, is evaluated here, but preferably only a smaller region near the optical axis of the camera device 62. This is illustrated in FIG. 6 by the dotted lines proceeding from the camera device 62.

Preferably, the actions performed by an operating person in connection with the handling of the container 7 or the bank notes 3 located therein are captured after capture of the bar code but in the total field of view of the camera device 62, and the thereby obtained image or video data are stored, for example in the form of a film or a consecutive series of images. The field of view of the camera device 62 is preferably so great here that if possible all the operating person's actions performed in the region of the support 5 can be captured. A corresponding field of view is indicated in FIG. 6 by dashed lines proceeding from the camera device 62.

Preferably, the camera device 62 can be arranged in the lower region, in particular in a base region 4', of the housing 4 of the system 1. It can be arranged, as in the hereinabove described systems, on the base region 4' of the housing 4 itself or else within the housing 4. The relevant expositions in connection with the example shown in FIG. 2 apply here accordingly.

Figure 7:
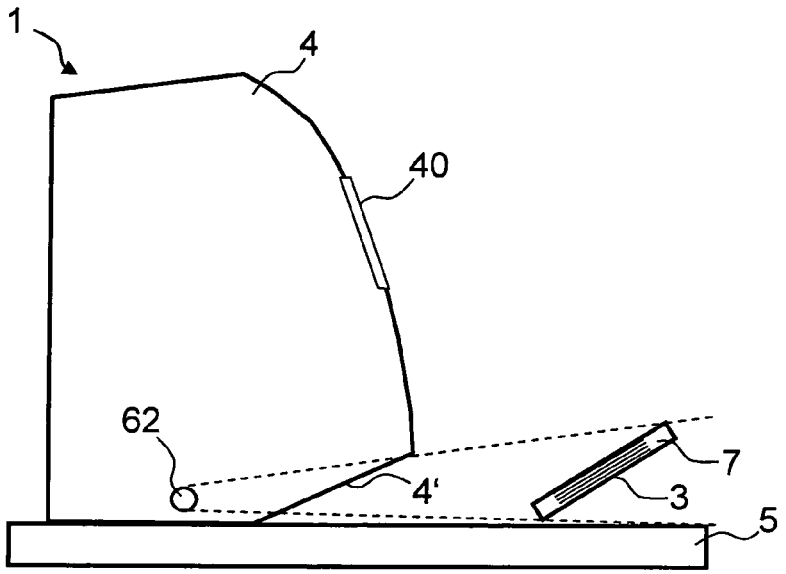
FIG. 7 the example of a value-document processing system shown in FIG. 6, in a side view.

FIG. 7 shows the example represented in FIG. 6 of a value-document processing system 1, in a side view. As indicated by the latter, the camera device 62 is integrated in the interior of the housing 4 at the level of the base region 4'. The base region 4' of the housing 4 can preferably be configured as a window through which the camera device 62 can read information items located on the container 7 and/or the bank-note stack 3 and/or record the operating person's actions performed in the region of the support 5. The window can be formed for example by a transparent pane or else be designed open. Otherwise, the above expositions in connection with the examples shown in FIGS. 2 to 6 apply accordingly.

Figure 8:
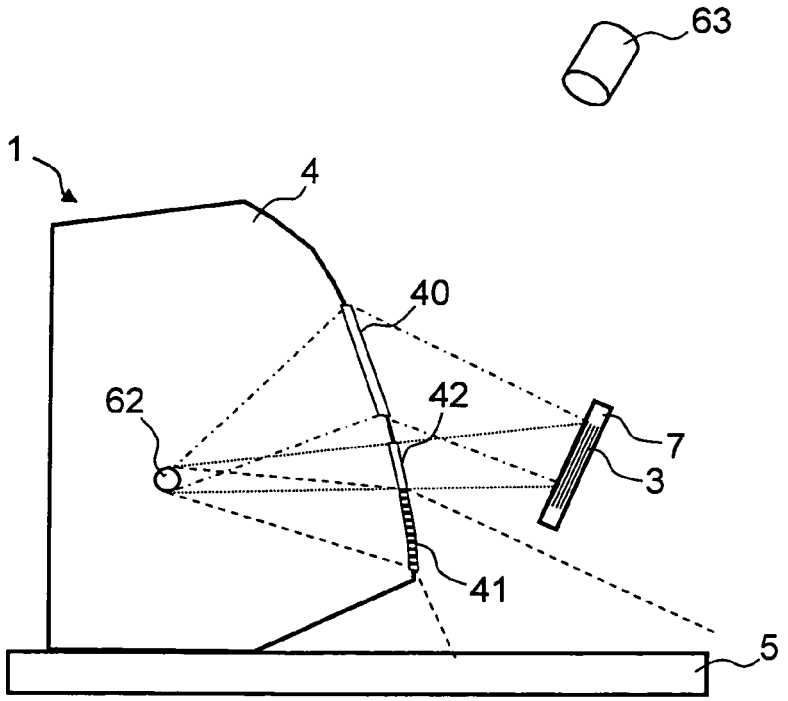
FIG. 8 a fourth example of a value-document processing system in a side view.

FIG. 8 shows a fourth example of a value-document processing system 1 in a side view. In this example, the camera device 62 is arranged in the interior of the housing 4. Further, there is provided in the front region of the housing 4 a first housing region 41 which is so configured that the actions performed by an operating person in the region of the support 5 can be captured by the camera device 62 therethrough. Preferably, the first housing region 41 has an optical imaging element by means of which objects located in the region of the support 5 or the operating person's hands are imaged onto the camera device 62. For example, the optical imaging element can be embodied by a Fresnel lens which preferably forms a part of the housing 4, as indicated schematically in FIG. 8. Field of view and ray path upon the recording of images or video sequences of the actions performed by an operating person are indicated in the figure by dashed lines.

Preferably, there is further provided a second housing region 42 through which the camera device 62 can capture additional information items, in particular in the form of bar codes, located on the container 7 and/or on the bank notes 3. The second housing region 42 is arranged here above the first housing region 41, so that bar codes located on the container 7 can be read in a comfortable manner while the container 7 is being placed by an operating person on the support 5 and thereby passes the field of view, which is indicated in the figure by dotted lines, of the camera device 62. Like the first housing region 41, the second housing region 42 can also have an optical imaging element by means of which the bar code located on the container 7 is imaged onto the camera device 62. Alternatively or additionally, however, it is also conceivable to furnish the camera device 62 with a camera objective which enables a reliable capture of the bar code located on the container 7 without the second housing region 42 needing to have imaging properties. In this case the second housing region 42 can merely have a transparent, for example dark-transparent, pane.

If one or all of the recording and/or reading devices 60, 61, 62 are attached in the interior of the housing 4, it may also be provided that the user interface 40 is configured such that it is transparent to the recording and/or reading device 60, 61, 62, so that the recording and/or reading device 60, 61, 62 captures images through the user interface. For this purpose, there can be employed for example an indicator or display which is transparent or can be put in a transparent state, e.g. an OLED display.

In addition to the recording device 60 or camera device 62 provided in the examples of FIGS. 2 to 6, it may be advantageous to provide a further recording device by means of which the operating person, in particular his actions, can be recorded from another perspective. This is illustrated with the help of FIG. 8 by way of example by a camera 63 which is arranged above the workplace defined by the housing 4 and/or the support 5 and is suitable for example for monitoring the operating person from an overhead perspective. The thereby obtained image or video data are stored like the image or video data obtained by means of the recording device 60 or camera device 62 and retrieved if necessary for a later check of the actions performed by the operating person.

The invention claimed is:

1. A system for processing value documents, comprising:

an apparatus for processing value documents including checking, counting, sorting and/or destroying value documents;

a housing in which the apparatus is integrated, and/or a support on which the apparatus is arranged;

a recording device provided in or on the housing and/or on the support for recording actions carried out by an operating person in a working region while operating the apparatus;

a reading device provided in or on the housing and/or on the support for capturing at least one information item from the working region, the at least one information item being for identifying the value documents intended for processing; and a control device which is configured for mutually associating the captured information item for identifying the value documents intended for processing and the image data obtained upon the recording of the actions carried out by the operating person, such that the captured information item and the image data are stored in a memory accordingly;

wherein the recording device and the reading device are given in the form of a camera device, the camera device comprising a wide-angle, low focal length camera configured to capture the near range and the far range at the same depth of field; and wherein the working region is located before the housing and/or the support.

2. The system according to claim 1, wherein the actions carried out by the operating person while operating the apparatus comprise supplying value documents intended for processing in the apparatus and/or removing value documents after their processing in the apparatus.

3. The system according to claim 1, wherein the recording device is configured for recording still and/or moving images of the actions carried out by the operating person while operating the apparatus.

4. The system according to claim 1, wherein the reading device is configured for capturing an information item located on a container for identifying value documents located in the container and intended for processing.

5. The system according to claim 1, wherein the information item for identifying the value documents intended for processing is given in the form of a bar code.

6. The system according to claim 1, wherein the camera device is integrated in the housing and there is provided on the housing at least one transparent housing region through which the camera device can capture the actions carried out by the operating person and/or the information item for identifying the value documents intended for processing.

7. The system according to claim 6, wherein a first housing region is so configured and/or arranged that the actions carried out by the operating person can be captured by the camera device therethrough.

8. The system according to claim 7, wherein the first and/or second housing region has an optical imaging element for imaging the actions carried out by the operating person or the information item for identifying the value documents onto the camera device.

9. The system according to claim 6, wherein a second housing region is so configured and/or arranged that the information item for identifying the value documents intended for processing can be captured by the camera device therethrough.

10. The system according to claim 9, wherein the first and/or second housing region has an optical imaging element for imaging the actions carried out by the operating person or the information item for identifying the value documents onto the camera device.

11. The system according to claim 1, wherein the support has at least one transparent placement area through which the actions carried out by the operating person can be recorded and/or the information item for identifying the value documents located on the placement area can be captured.

12. The system according to claim 1, wherein the recording and/or reading device is attached in the interior of the housing, and a user interface is transparent to the recording and/or reading device.

13. A method for processing value documents by which actions carried out by an operating person in a working region while operating an apparatus for processing value documents are recorded by a recording device, wherein the recording device is provided in or on a housing in which the apparatus is integrated, and/or on a support on which the apparatus is arranged; and by which at least one information item for identifying the value documents intended for processing is captured from the working region by a reading device, wherein the reading device is provided in or on a housing in which the apparatus is integrated, and/or on a support on which the apparatus is arranged;

wherein the recording device and the reading device are given in the form of a camera device, the camera device comprising a wide-angle, low focal length camera configured to capture the near range and the far range at the same depth of field;

wherein the captured information item for identifying the value documents intended for processing and the recording of the actions carried out by the operating person are mutually associated and stored in a memory by a control device; and wherein the working region is located before the housing and/or the support.

14. The system according to claim 7, wherein the first housing region has an optical imaging element for imaging the actions carried out by the operating person or the information item for identifying the value documents onto the camera device, the optical imaging element comprising a Fresnel lens forming a part of the housing.

15. A system for processing value documents, comprising:

an apparatus for processing value documents including checking, counting, sorting and/or destroying value documents;

a housing in which the apparatus is integrated, and/or a support on which the apparatus is arranged;

a recording device provided in or on the housing and/or on the support for recording actions carried out by an operating person in a working region while operating the apparatus;

a reading device provided in or on the housing and/or on the support for capturing at least one information item from the working region, the at least one information item being for identifying the value documents intended for processing; and a transparent placement area extending from the housing and/or the support and including a depression for receiving the value documents;

wherein the recording device and the reading device are provided below the transparent placement area and capture the actions of the operator and the at least one information item there through; and wherein the working region is defined by the transparent placement area.

16. The system according to claim 1, wherein the apparatus for processing value documents comprises a sensor device provided within the housing for capturing physical properties of the value documents.

17. The system according to claim 1, further comprising an input pocket and an output pocket in or on the housing and/or on the support for inputting and outputting value documents to the apparatus for processing value documents, wherein the input pocket and the output pocket are located in the working region.

18. The system according to claim 1, wherein the recording device is configured to begin recording upon the capture of the at least one information item by the reading device.

19. The system according to claim 15, wherein the transparent placement area comprises an elongate support extending from the housing at an angle of 90°.

* * * * *